US011065521B2

(12) United States Patent
Chen

(10) Patent No.: US 11,065,521 B2
(45) Date of Patent: Jul. 20, 2021

(54) PUNCHING-TRAINING DEVICE

(71) Applicant: Pang Mei Sport Co., Ltd., Changhua County (TW)

(72) Inventor: Chih-Lung Chen, Changhua County (TW)

(73) Assignee: PANG MEI SPORT CO., LTD., Lugang Township, Changhua County (TW)

( * ) Notice: Subject to any disclaimer, the term of this patent is extended or adjusted under 35 U.S.C. 154(b) by 0 days.

(21) Appl. No.: 16/711,085

(22) Filed: Dec. 11, 2019

(65) Prior Publication Data

US 2021/0178239 A1 Jun. 17, 2021

(51) Int. Cl.
*A63B 69/00* (2006.01)
*A63B 69/20* (2006.01)

(52) U.S. Cl.
CPC ..... *A63B 69/004* (2013.01); *A63B 69/20* (2013.01)

(58) Field of Classification Search
CPC ..... A63B 69/004; A63B 69/20–26; A63B 69/32–325; A63B 69/00
See application file for complete search history.

(56) References Cited

U.S. PATENT DOCUMENTS 4,249,727 A * 2/1981 Dehan ..... A63B 21/015 482/117
4,576,379 A * 3/1986 Juhasz ..... A63B 69/0079 473/430
4,903,966 A * 2/1990 Liao ..... A63B 69/0091 473/423
5,071,122 A * 12/1991 Messina ..... A63B 69/0053 473/429
5,303,914 A * 4/1994 Cooksey ..... A63B 69/0091 473/429
5,352,170 A * 10/1994 Condo ..... A63B 69/201 482/83
5,554,088 A * 9/1996 Zlojutro ..... A63B 69/004 482/83
6,786,854 B1 * 9/2004 Hsu ..... A63B 69/208 482/83
7,771,294 B2 * 8/2010 Goucher ..... A63B 69/0002 473/451
8,262,515 B2 * 9/2012 Morris ..... A63B 69/002 473/420

(Continued)

*Primary Examiner* — Nyca T Nguyen
(74) *Attorney, Agent, or Firm* — Muncy, Geissler, Olds & Lowe, P.C.

(57) ABSTRACT

A punching-training device includes a support body, having a seat end and an assembling end; a punching mechanism, including a plurality of punched members which are freely rotatable and separately mounted to the assembling end; wherein the assembling end includes small diameter shafts on which the punched members are rotatably mounted and are smaller than the seat end; the assembling end further includes a supporting rod, at least one interposed member and a stop portion, a first one of the small diameter shafts is connected between the supporting rod and the at least one interposed member, a second one of the small diameter shafts is arranged at an end of the at least one interposed member, and the stop portion is detachably connected at an end of the second one of the small diameter shafts.

7 Claims, 5 Drawing Sheets

(56) References Cited

U.S. PATENT DOCUMENTS 8,262,516 B2 * 9/2012 Fuentes ..... A63B 69/0079 473/429
9,724,582 B2 * 8/2017 Burrell ..... A63B 69/0002
9,744,420 B1 * 8/2017 Bergamini ..... A63B 69/0053
9,839,827 B1 * 12/2017 Roberts ..... A63B 69/203
10,406,419 B1 * 9/2019 Dickerson ..... A63B 69/0075
2003/0036446 A1 * 2/2003 Udwin ..... A63B 69/0075 473/417
2003/0224880 A1 * 12/2003 Hansberry ..... A63B 69/0002 473/430
2006/0025284 A1 * 2/2006 Livingstone ..... A63B 69/24 482/83
2007/0167297 A1 * 7/2007 Stevenson ..... A63B 69/004 482/83
2007/0197348 A1 * 8/2007 Ku ..... A63B 69/24 482/83
2009/0247374 A1 * 10/2009 Chen ..... A63B 69/24 482/89
2013/0053188 A1 * 2/2013 Moore ..... A63B 69/0091 473/423
2013/0085044 A1 * 4/2013 Chen ..... A63B 69/20 482/87
2013/0221615 A1 * 8/2013 Stevens Kang ..... A63B 57/40 273/127 B
2013/0324372 A1 * 12/2013 Cuadrado ..... A63B 69/20 482/90
2014/0128226 A1 * 5/2014 Chang ..... A63B 69/20 482/83
2014/0302969 A1 * 10/2014 Chen ..... A63B 69/203 482/90
2014/0329646 A1 * 11/2014 Johnson ..... A63B 69/004 482/83
2015/0273307 A1 * 10/2015 Karimi ..... A63B 69/34 482/8
2016/0236054 A1 * 8/2016 Johnson ..... A63B 69/004
2017/0014666 A1 * 1/2017 Sather ..... A63B 23/03541
2017/0173377 A1 * 6/2017 Zaykov ..... A63B 23/0405
2017/0348577 A1 * 12/2017 Chen ..... A63B 69/20
2018/0021650 A1 * 1/2018 Hoover ..... A63B 69/20 482/83
2018/0161657 A1 * 6/2018 Direnzo ..... A63B 69/208
2018/0304138 A1 * 10/2018 Conley ..... A63B 69/32
2019/0192940 A1 * 6/2019 Wharton ..... A63B 69/004
2020/0155914 A1 * 5/2020 Hu ..... A63B 69/208

* cited by examiner

PUNCHING-TRAINING DEVICE

BACKGROUND OF THE INVENTION

Field of the Invention

The present invention relates to a punching-training device.

Description of the Prior Art

Conventionally, a hit-practicing device has a target for a user to practice striking skills.

In a conventional hit-practicing device, the target is only positioned at one position, so that the user cannot adjust the target to a suitable angle, it causes the angular limitation of a hit training. The user needs to purchase different kinds of hit-practicing devices to meet different needs, so it is inconvenient to use and also increases a cost of the hit training.

The present invention is, therefore, arisen to obviate or at least mitigate the above-mentioned disadvantages.

SUMMARY OF THE INVENTION

The main object of the present invention is to provide a punching-training device which can meet needs of various positions and angles of target for punching.

To achieve the above and other objects, the present invention provides a punching-training device, including: a support body, having a seat end and an assembling end; a punching mechanism, including a plurality of punched member which are freely rotatable and separately mounted to the assembling end.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
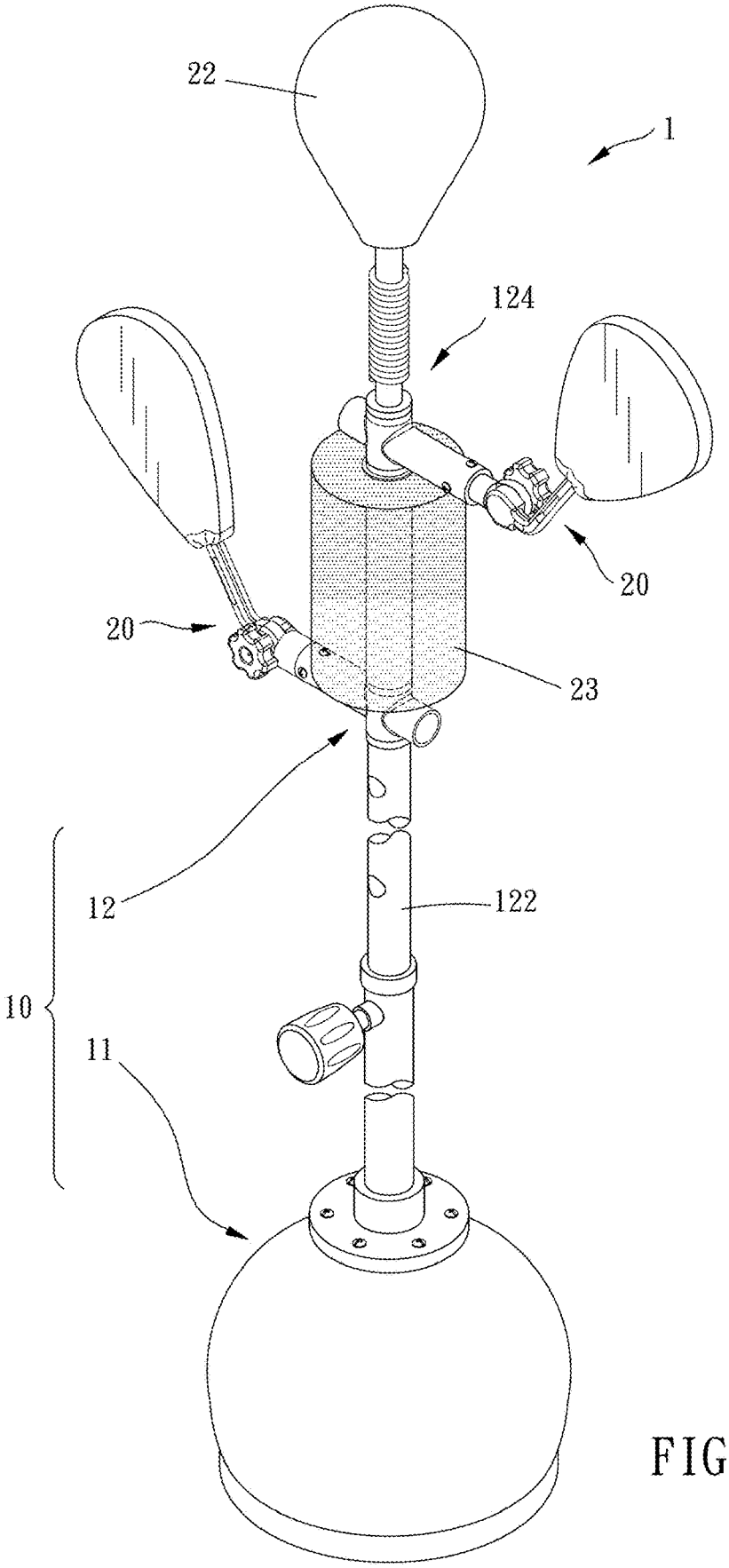
FIG. 1 is a stereogram of a preferable embodiment of the present invention.
Figure 2:
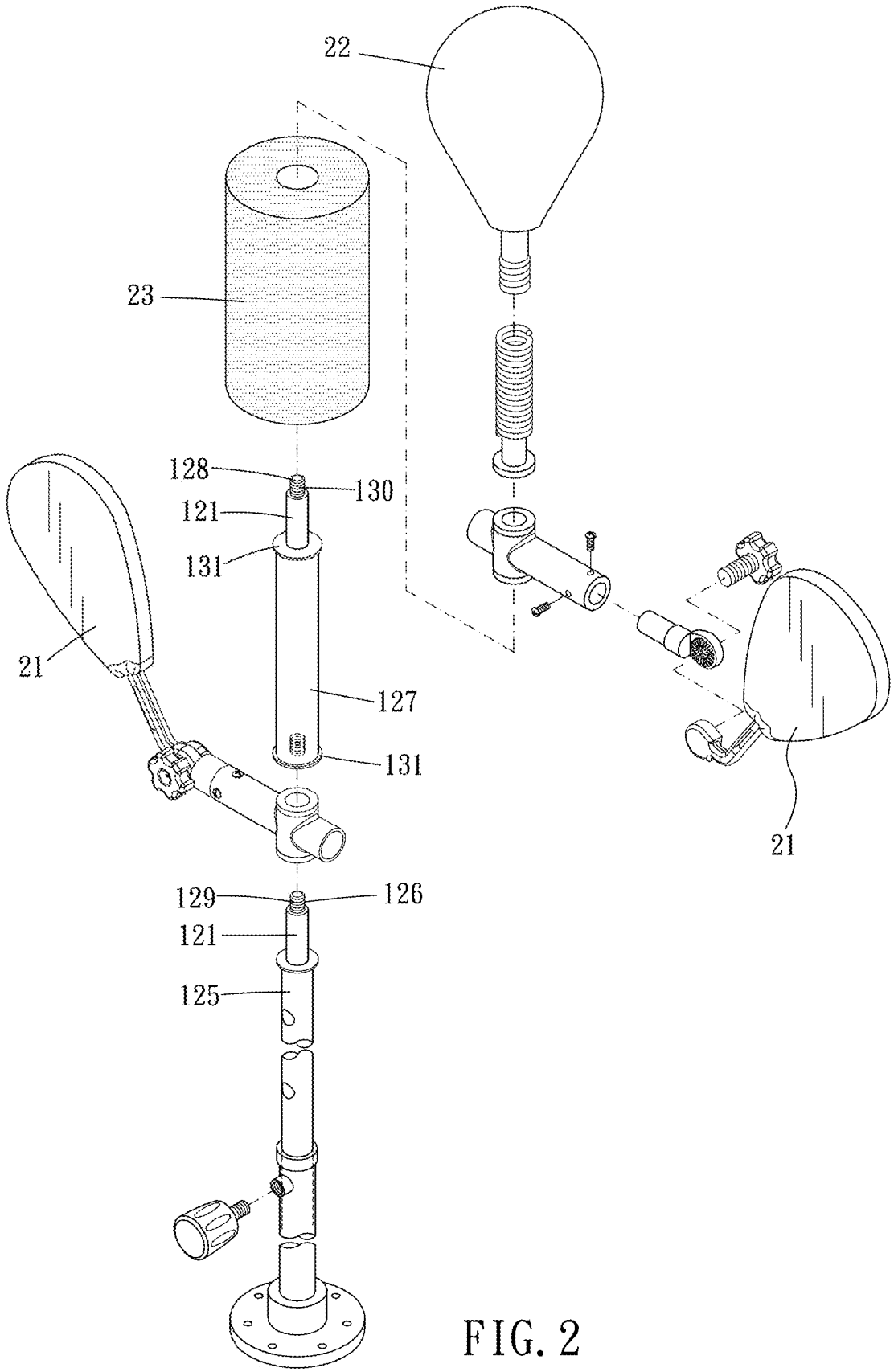
FIG. 2 is a breakdown drawing of a preferable embodiment of the present invention.
Figure 3:
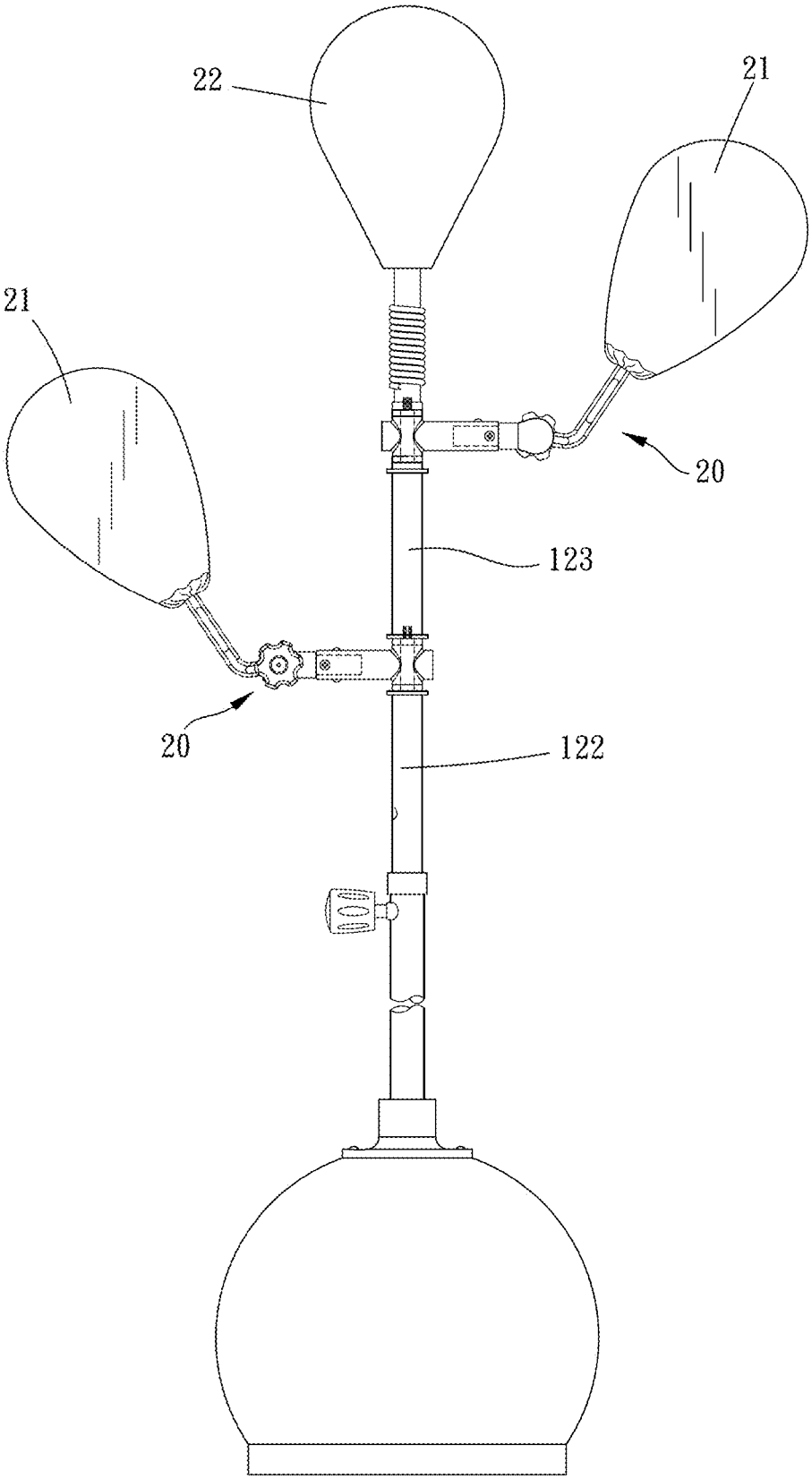
FIG. 3 is a side view of a preferable embodiment of the present invention.
Figure 4:
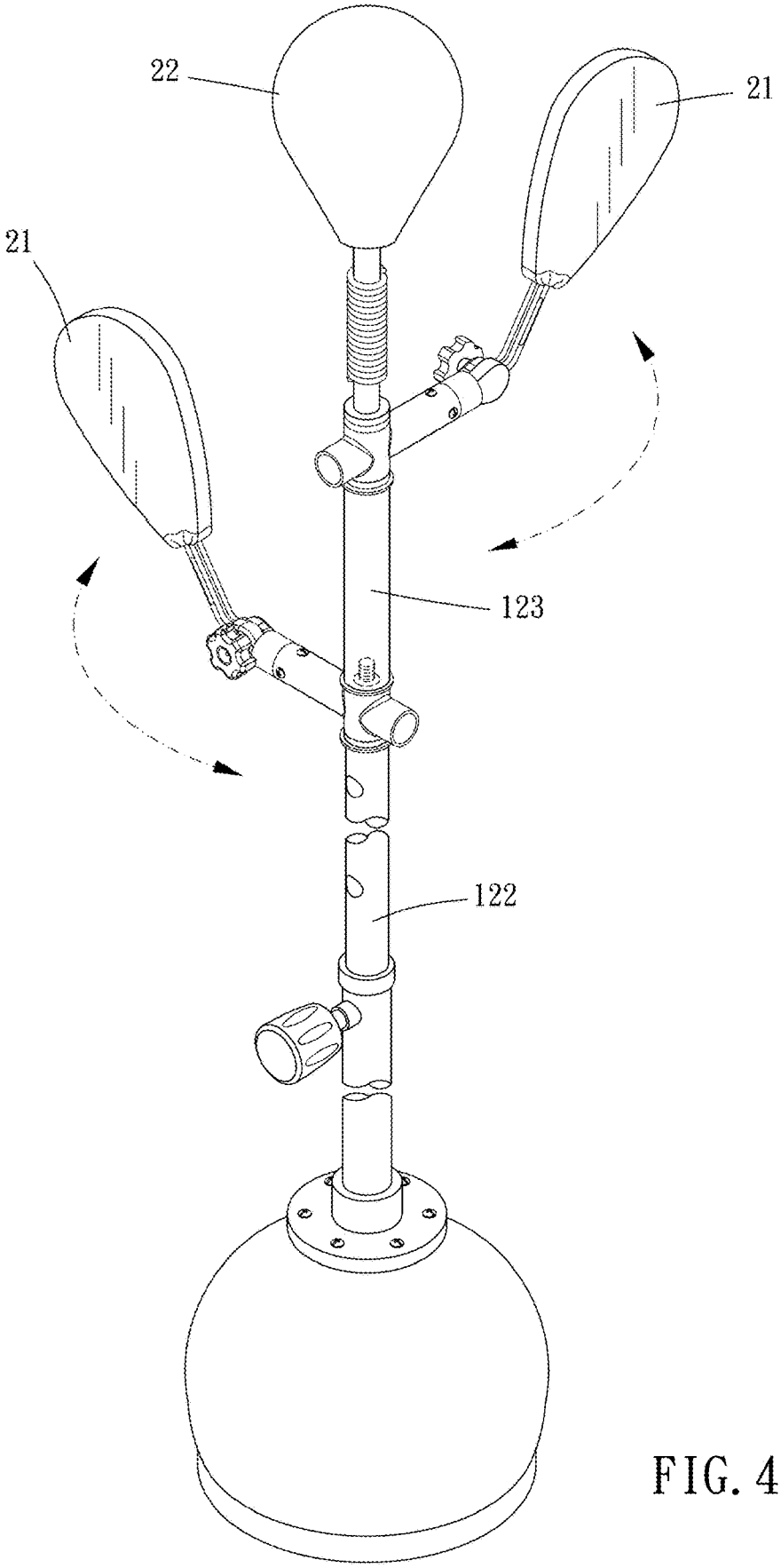
FIGS. 4 and 5 are drawings showing operation of a preferable embodiment of the present invention.
Figure 5:
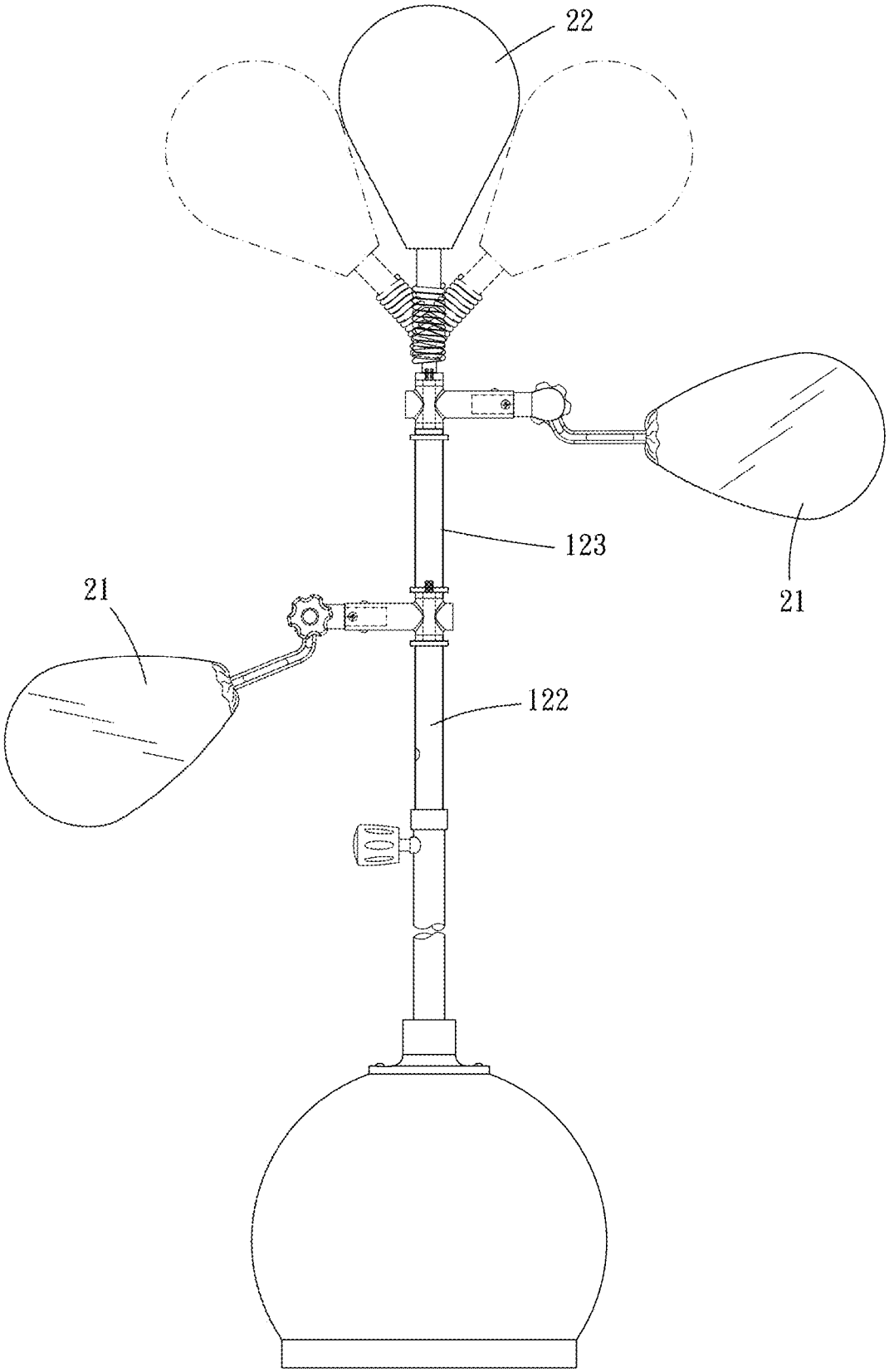

Please refer to FIGS. 1 to 5 for a preferable embodiment of the present invention. A punching-training device 1 includes a support body 10 and a punching mechanism 20.

The support body 10 includes a seat end 11 and an assembling end 12. The punching mechanism 20 includes a plurality of punched members 21 which are freely rotatable and separately mounted to the assembling end 12, wherein each said punched member 21 may be totally freely rotatable for 360 or a limited degrees. Whereby, it can meet needs of various positions and angles of target for punching.

The assembling end 12 includes a plurality of small diameter shafts 121 on which the plurality of punched members 21 are rotatably mounted, in which each said punched member 21 may be adjustable and locked in a specific angle and position. The assembling end 12 further includes a supporting rod 122, at least one interposed member 123 and a stop portion 124. The supporting rod 122 includes a first large diameter section 125, one said small diameter shaft 121 connected with the first large diameter section 125, and a first connection end 126 disposed at one end of the one said small diameter shaft 121. The at least one interposed member 123 includes a second large diameter section 127 detachably connected with the first connection end 126, another one said small diameter shaft 121 connected with the second large diameter section 127, and a second connection end 128 disposed at one end of the another one said small diameter shaft 121 and detachably connected with the stop portion 124. The first connection end 126 includes a male or female threaded structure 129, the second connection end 128 includes a male or female threaded structure 130, the at least one interposed member 123 is screwed to the first connection end 126, and the stop portion 124 is screwed to the second connection end 128, which is easy to assemble/disassemble and provides various arrangements of the punched members. The stop portion 124 may further include another punched member 22, the another punched member 22 may be identical or nonidentical to said punched member 21.

The supporting rod 122 is retractable so that the height of the punched member 21 is adjustable. According to various manufacturing or assembling requirements, the first large diameter section 125 is integrally formed with or detachably connected with the one said small diameter shaft 121 and the first connection end 126; each said second large diameter section 127 is integrally formed with or detachably connected with the another one said small diameter shaft 121 and the second connection end 128. Respective diameters of the first connection end 126 and the second connection end 128 are smaller than a diameter of the small diameter shaft 121, thus being capable of restricting assembling position without any additional elements. Preferably, the second large diameter section 127 is longer than each said small diameter shaft 121, which can stably hold the punched member 21.

Each of two distal ends of each said second large diameter section 127 includes a radial flange 131, which can improve the structural strength and stability. Each said second large diameter section 127 has a length equal to or greater than 10 centimeters, and the punching mechanism 20 preferably further includes at least one cushion member 23 located between the plurality of punched members 21 and disposed around the assembling end 12, thus providing additional punching region.

In other embodiments, the punching-training device may include a plurality of interposed member, wherein neighboring two of the interposed members are detachably connected in series and define one small diameter shaft. The interposed members may have second large diameter sections of the same length; or at least two of the plurality of interposed members may have second large diameter sections of different lengths, which can simulate punching coming from different height and/or position.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A punching-training device, including:

a support body, having a seat end and an assembling end;

a punching mechanism, including a plurality of punched member which are freely rotatable and separately mounted to the assembling end, wherein the assembling end includes a plurality of small diameter shafts on which the plurality of punched members are rotatably mounted, and each of the plurality of small diameter shafts is smaller than the seat end, and wherein the assembling end further includes a supporting rod, at least one interposed member and a stop portion, the supporting rod includes a first large diameter section, one said small diameter shaft connected with the first large diameter section, and a first connection end disposed at one end of the one said small diameter shaft, and the at least one interposed member includes a second large diameter section detachably connected with the first connection end, another one said small diameter shaft connected with the second large diameter section, and a second connection end disposed at one end of the another one said small diameter shaft and detachably connected with the stop portion.

2. The punching-training device of claim 1, wherein said second large diameter section has a length equal to or greater than 10 centimeters.

3. The punching-training device of claim 1, wherein the first connection end includes a male or female threaded structure, the second connection end includes a male or female threaded structure, the at least one interposed member is screwed to the first connection end, and the stop portion is screwed to the second connection end.

4. The punching-training device of claim 3, wherein the supporting rod is retractable, the first large diameter section is integrally formed with or detachably connected with the one said small diameter shaft and the first connection end; said second large diameter section is integrally formed with or detachably connected with the another one said small diameter shaft and the second connection end; respective diameters of the first connection end and the second connection end are smaller than a diameter of each of the plurality of small diameter shafts; the second large diameter section is longer than each said small diameter shaft; each of two distal ends of said second large diameter section includes a radial flange; said second large diameter section has a length equal to or greater than 10 centimeters.

5. The punching-training device of claim 1, wherein the second large diameter section is longer than each said small diameter shaft.

6. The punching-training device of claim 1, wherein each of two distal ends of said second large diameter section includes a radial flange.

7. The punching-training device of claim 1, wherein the punching mechanism further includes at least one cushion member located between the plurality of punched members and disposed around the assembling end.

* * * * *